US009382044B2

(12) United States Patent
Chanas et al.

(10) Patent No.: US 9,382,044 B2
(45) Date of Patent: Jul. 5, 2016

(54) LOCKING DEVICE FOR A CAP

(71) Applicant: A. Raymond et Cie, Grenoble (FR)

(72) Inventors: Quentin Chanas, Sesinet Pariset (FR); Guillaume Belle, Sassenage (FR)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 14/375,372

(22) PCT Filed: Feb. 6, 2013

(86) PCT No.: PCT/EP2013/052273
§ 371 (c)(1),
(2) Date: Jul. 29, 2014

(87) PCT Pub. No.: WO2013/120739
PCT Pub. Date: Aug. 22, 2013

(65) Prior Publication Data

US 2015/0014316 A1 Jan. 15, 2015

(30) Foreign Application Priority Data

Feb. 13, 2012 (FR) ..... 12 51306

(51) Int. Cl.
*A61J 1/00* (2006.01)
*B65D 41/48* (2006.01)
(Continued)

(52) U.S. Cl.
CPC ..... *B65D 41/48* (2013.01); *A61J 1/2096* (2013.01); *B65D 51/002* (2013.01); *A61J 1/1418* (2015.05); *A61J 1/201* (2015.05); *B65D 2251/0015* (2013.01); *B65D 2251/0075* (2013.01)

(58) Field of Classification Search
CPC ..... B65D 41/48; B65D 51/002; B65D 2251/0015; B65D 2251/075; A61J 1/1418; A61J 1/2096; A61J 1/201
USPC ..... 215/247, 249, 277, DIG. 3, 302; 604/415
See application file for complete search history.

(56) References Cited

U.S. PATENT DOCUMENTS 2,162,752 A 6/1939 Schauer
2,162,754 A 6/1939 Schauer
(Continued)

FOREIGN PATENT DOCUMENTS

DE 9306796 U1 7/1993
DE 19708909 A1 9/1998
(Continued)

OTHER PUBLICATIONS

Office Action from Canadian I.P. Office for Application No. 2,771,368 dated Apr. 8, 2013.
(Continued)

*Primary Examiner* — James N Smalley
(74) *Attorney, Agent, or Firm* — Harness, Dickey & Pierce, P.L.C.

(57) ABSTRACT

A locking device is disclosed for locking a cap on a container with a flange including a lid housing a bushing provided with lower inner notches supported under the flange and outer notches engaging with a groove in the lid to secure the bushing to the lid, the lid including a severable frangible zone, the bushing being formed by a ring extended by lugs intended to surround the cap and provided with at least one deformable and severable bridge provided opposite the lugs and capable of being elastically deformed radially to allow the forced insertion of the flange into the bushing and of being broken to allow the removal of the bushing relative to the flange followed by the removal of the cap from the container.

27 Claims, 3 Drawing Sheets

(51) Int. Cl.
*B65D 51/00* (2006.01)
*A61J 1/20* (2006.01)

(56) References Cited

U.S. PATENT DOCUMENTS

| | | | | |
|---|---|---|---|---|
| 2,961,119 | A | 11/1960 | Leach | |
| 3,117,701 | A | 1/1964 | Stull | |
| 3,193,128 | A | 7/1965 | Ravin | |
| 3,603,471 | A | 9/1971 | Harris, Sr. et al. | |
| 3,823,841 | A | 7/1974 | Lovejoy | |
| 3,920,141 | A | 11/1975 | Bojardi | |
| 4,205,754 | A * | 6/1980 | Nielsen | B65D 51/002 215/249 |
| 4,211,333 | A | 7/1980 | Villarejos | |
| 4,251,003 | A | 2/1981 | Bodenmann | |
| 4,456,138 | A | 6/1984 | Bereziat | |
| 4,482,071 | A * | 11/1984 | Ishiwatari | 215/255 |
| 4,664,277 | A * | 5/1987 | Connor | 215/249 |
| 4,844,267 | A * | 7/1989 | von Schuckmann | 215/253 |
| 5,085,332 | A | 2/1992 | Gettig et al. | |
| 5,088,612 | A | 2/1992 | Storar et al. | |
| 5,125,921 | A | 6/1992 | Duschek | |
| 5,303,835 | A | 4/1994 | Haber et al. | |
| 5,305,835 | A | 4/1994 | Campbell et al. | |
| 5,314,084 | A * | 5/1994 | Folta et al. | 215/249 |
| 5,447,247 | A * | 9/1995 | Derksen | 215/247 |
| 5,467,878 | A | 11/1995 | Derksen | |
| 5,555,988 | A | 9/1996 | Koch et al. | |
| 5,562,219 | A | 10/1996 | de Pous et al. | |
| 5,718,348 | A * | 2/1998 | Manera | 215/249 |
| 5,738,233 | A | 4/1998 | Burns | |
| 5,799,810 | A | 9/1998 | de Pous et al. | |
| 5,817,082 | A | 10/1998 | Niedospial, Jr. et al. | |
| 5,819,964 | A | 10/1998 | Grimard | |
| 5,823,373 | A | 10/1998 | Sudo et al. | |
| 5,957,314 | A | 9/1999 | Nishida et al. | |
| 5,972,297 | A | 10/1999 | Niermann et al. | |
| 5,992,660 | A | 11/1999 | Miura et al. | |
| 6,042,770 | A | 3/2000 | Sudo et al. | |
| 6,095,355 | A | 8/2000 | Jessen et al. | |
| 6,186,359 | B1 | 2/2001 | de Pous et al. | |
| 6,341,706 | B1 | 1/2002 | Neuner | |
| 6,378,714 | B1 | 4/2002 | Jansen et al. | |
| 6,409,049 | B1 | 6/2002 | de Pous et al. | |
| 6,543,648 | B2 | 4/2003 | de Pous et al. | |
| 6,568,439 | B1 | 5/2003 | Se et al. | |
| 6,588,614 | B2 | 7/2003 | Neuner | |
| 6,591,998 | B2 | 7/2003 | Haynes et al. | |
| 6,601,721 | B2 | 8/2003 | Jansen et al. | |
| 6,604,561 | B2 | 8/2003 | Py | |
| 6,681,475 | B2 | 1/2004 | Jansen et al. | |
| 6,739,781 | B2 | 5/2004 | Maloney et al. | |
| 6,868,978 | B2 | 3/2005 | Amschlinger et al. | |
| 6,904,662 | B2 | 6/2005 | Thibault et al. | |
| 7,100,646 | B2 | 9/2006 | Py et al. | |
| 7,198,757 | B2 | 4/2007 | Chiarin | |
| 7,243,689 | B2 | 7/2007 | Py | |
| 7,309,469 | B2 | 12/2007 | Anderson et al. | |
| 7,488,307 | B2 | 2/2009 | Rimlinger et al. | |
| 7,490,639 | B2 | 2/2009 | Py | |
| 7,562,783 | B2 | 7/2009 | Bourreau et al. | |
| 7,611,025 | B2 | 11/2009 | Nusbaum et al. | |
| 7,611,026 | B1 | 11/2009 | Bloom et al. | |
| 7,712,618 | B2 | 5/2010 | Barre et al. | |
| 7,726,357 | B2 | 6/2010 | Py et al. | |
| 7,810,529 | B2 | 10/2010 | Py | |
| 7,841,484 | B2 | 11/2010 | Kaneko et al. | |
| 7,845,505 | B2 | 12/2010 | Hamamoto et al. | |
| 7,850,028 | B2 | 12/2010 | Morini | |
| 7,922,019 | B2 | 4/2011 | Granger | |
| 7,967,034 | B2 | 6/2011 | Py | |
| RE42,533 | E | 7/2011 | Josypenko | |
| 7,980,276 | B2 | 7/2011 | Py | |
| 8,056,756 | B2 | 11/2011 | Okiyama | |
| 8,225,949 | B2 | 7/2012 | Aneas | |
| 8,303,914 | B2 | 11/2012 | Zurcher | |
| 8,684,204 | B2 | 4/2014 | Belle | |
| 8,684,225 | B2 | 4/2014 | Gelibert et al. | |
| 2003/0029828 | A1 * | 2/2003 | Amschlinger | A61J 1/1412 215/247 |
| 2003/0098286 | A1 | 5/2003 | Bloom et al. | |
| 2003/0108455 | A1 | 6/2003 | Brockwell | |
| 2004/0217081 | A1 | 11/2004 | Konrad | |
| 2004/0217082 | A1 * | 11/2004 | Claessens | 215/249 |
| 2007/0102393 | A1 | 5/2007 | Colin et al. | |
| 2007/0131641 | A1 | 6/2007 | Higgins | |
| 2007/0272648 | A1 | 11/2007 | Hamamoto et al. | |
| 2008/0105640 | A1 | 5/2008 | Ott | |
| 2008/0237178 | A1 | 10/2008 | Ochoa Laburu | |
| 2009/0184086 | A1 * | 7/2009 | Fraser | B65D 41/086 215/331 |
| 2010/0050575 | A1 | 3/2010 | Aneas | |
| 2010/0089862 | A1 | 4/2010 | Schmitt | |
| 2010/0243599 | A1 | 9/2010 | Chae | |
| 2012/0160850 | A1 | 6/2012 | Gelibert et al. | |
| 2012/0187072 | A1 | 7/2012 | Belle | |

FOREIGN PATENT DOCUMENTS

| | | | |
|---|---|---|---|
| FR | 2036746 | A1 | 12/1970 |
| FR | 2893922 | A1 | 6/2007 |
| FR | 2908396 | A1 | 5/2008 |
| JP | 378947 | | 1/1960 |
| JP | 7165252 | A | 6/1995 |
| JP | 2007-137482 | A | 6/2007 |
| WO | WO-94/04424 | A1 | 3/1994 |
| WO | WO-9953886 | A1 | 10/1999 |
| WO | WO-2006120539 | A2 | 11/2006 |

OTHER PUBLICATIONS

Office Action for Russian Patent Application No. 2012117567 dated Jul. 23, 2013.

Office Action from Canadian I.P. Office for Application No. 2,773,172 dated Mar. 28, 2013.

Office Action from Korean I.P. Office for Application No. 10-2012-7009278 dated Jun. 28, 2013.

Office Action from Japanese I.P. Office for Application No. 2012-531304 dated Jun. 25, 2013.

Examination Report from New Zealand I.P. Office for Application No. 598359 dated Nov. 8, 2012.

* cited by examiner

LOCKING DEVICE FOR A CAP

CROSS-REFERENCE TO RELATED APPLICATIONS

This application is a National Phase Entry of International Application No. PCT/EP2013/052273, filed on Feb. 6, 2013, which claims priority to French patent application Ser. No. 12/51306, filed on Feb. 13, 2012, both of which are incorporated by reference herein.

TECHNICAL FIELD

A device for locking a stopper on a container having a flange, comprises a cap which, being provided with at least one internal groove, exhibits a shape allowing coverage of the stopper, envelopment of the flange and the resultant inaccessibility of the stopper, a collar which, being suitable for housing inside the cap, is provided both with lower internal lugs that are intended to support the flange and cause the collar to press against the container, and with external lugs that can engage with the groove in order to secure said collar to said cap. The device relates furthermore to a container which, having a flange, is obturated by means of a stopper and is provided on its flange with such a stopper locking device.

BACKGROUND

Such locking devices are used to advantage notably in the medical field for reliably locking a stopper that is used to obturate a flanged container that contains, for example, an active medium in liquid, powder or freeze-dried form. Use of such locking devices ensures the impermeability of the container and the integrity of the contents thereof while facilitating detection of any prior broach of the container. This type of locking device can most commonly be found on flanged containers that are obturated by means of a stopper.

FR 2 893 922 discloses such a locking device wherein a cap, which is traversed by an axial aperture that is closed off by means of a capsule, is intended to cover both the stopper and the container flange. This cap comprises an external wall and an internal wall between which is arranged a circular elongated gap wherein are disposed at least one upper circular groove and one lower circular groove. This locking device moreover features a manipulation body which, being provided with external elastic tongues, is housed inside said elongated gap and can displace between an upper position in which the elastic tongues thereof engage with the upper circular groove and a lower position in which the elastic tongues thereof engage with the lower circular groove. The manipulation body is traversed by an orifice that is positioned facing the aperture in the cap and closed by means of a detachable cover that is connected to the manipulation body by means of weld points. Additionally, the manipulation body comprises an annular lip that is oriented towards the aperture in the cap. Finally, the stopper features a lateral recess which, when the manipulation body is raised, allows the venting of water molecules from the container contents as they undergo freeze-drying. Following the freeze-drying procedure, the manipulation body is returned to its lower position in which the container is sealed tight. While in the lower position, the annular lip of the cover penetrates the stopper to delimit a clean and sterile central section. Prior to use, the cover is loosened from the manipulation body by breaking the weld points. The user is thus able to insert a needle through the aperture and the orifice and then through the stopper in order to, for example, inject into the container a reconstitutive fluid prior to removing mixture by means of suction.

FR 2 950 865 also discloses a locking device comprising a cap which, being traversed axially by an aperture that is closed by means of a capsule, is intended to cover both the stopper and the flange of the container. This locking device also features a muzzle which, fitting inside the cap, is formed by an upper band and a lower band that are interconnected by fingers separated by lateral interstices. The mouth of the upper band is arranged so as to align with the opening in the cap. Thus, following removal of the capsule, the user can insert a sampling needle through the aperture and orifice and into the stopper in order to, for example, inject into the container a reconstitutive fluid prior to suctioning the mixture. After the locking device has been assembled, securing tabs underneath the capsule are squeezed between the upper band of the muzzle and the cap. Following withdrawal of the capsule, it is no longer possible to return the securing tabs to their original positions. The action of removing the capsule is thus made irreversible and it is no longer possible to return it to its initial position. This makes any prior use easily detectible.

Prior locking devices permit access to the contents of the container only via an area that is smaller than that of the neck of the container. Effectively, any removal of content is restricted to withdrawal by means of a needle introduced through the stopper. Such devices do not permit access to the entirety of the contents of the container by using all of the area afforded by the neck orifice. In addition, prior devices do not allow the attachment of the flange of the container, for example, to that of another container in order to decant the contents from one container to another. Thus, prior locking devices limit the application thereof and are therefore unsatisfactory.

SUMMARY

The present device has as its aim the remediation of the aforementioned disadvantages by proposing one embodiment of a device for locking a stopper that sits on a flanged container, the manufacture whereof is simplified by limiting the quantity of inputs required and whose ease of assembly provides for the simple, effective, rapid and irreversible locking of the stopper on the container while permitting, following unlocking, the flange of the container to be attached to another container while affording access to the inside of the container via the full internal surface of the container neck. A device for locking a stopper on a container having a flange, such device comprising a cap that is provided with at least one internal groove and being so formed as to cover the stopper while surrounding the flange in order to prevent access to the stopper, a collar which, capable of being housed inside the cap, is provided with lower internal lugs that are intended to provide support underneath the flange for the purpose of causing the collar to interlock with the container and with external lugs that can engage with the groove in order to cause the collar to interlock with the cap, characterized in that the cap comprises at least one frangible zone that can be broken so as to permit opening of the cap and the withdrawal thereof relative to the flange, the collar is formed by a band which, being extended by means of tenons that are intended to surround the stopper, is provided with at least one deformable and breakable bridge arranged opposite the tenons and capable, on the one hand, of radial elastic deformation so as to permit the forced insertion of the flange into the collar and on the other, to be broken in order to permit withdrawal of the collar from the flange and subsequent removal of the stopper from the container. The concept underlying the device is the employment of a cap and a collar that can be opened individually so as to disencumber the full surface of the flange and so permit the connection thereof.

The present device may therefore advantageously have the following distinguishing features:

- the free ends of the tenons are independent from one another;
- each tenon is provided with at least one internal web which, being intended to provide support against the flange, has a diameter that is less than that of the band;
- the collar also comprises upper internal lugs that are intended to press against the stopper;
- the cap comprises a disk that is extended axially by means of a skirt, the frangible zone being delimited by means of a double groove which, being of a thickness that is reduced relative to the rest of the cap, comprises at least a first leg extending over at least a part of such skirt and at least a second leg extending over at least one part of the cover, the locking device furthermore comprising a peelable capsule that can be attached at no less than one connection point of the frangible zone in order to allow removal of the capsule in order to initiate rupture of such frangible zone;
- the cap comprises a hinge zone, which, being of a thickness that is less than that of the rest of the cap, is arranged diametrally opposite the second section of the breakable zone and so disposed as to permit the radial opening of the cap following rupture of the breakable zone; and
- at least one of the cap, collar and capsule is made from molded plastic.

The present device also relates to a container which, having a flange, is obturated by means of a stopper and is provided with a device, as described above, for locking a stopper on top of the flange.

BRIEF DESCRIPTION OF THE DRAWINGS

The present invention will be described to better advantage and the novelties thereof more clearly elucidated with the aid of a detailed disclosure of one variant presented as a purely non-restrictive example thereof and illustrated by means of the drawing figures appended hereto, wherein.

DETAILED DESCRIPTION

Figure 1:
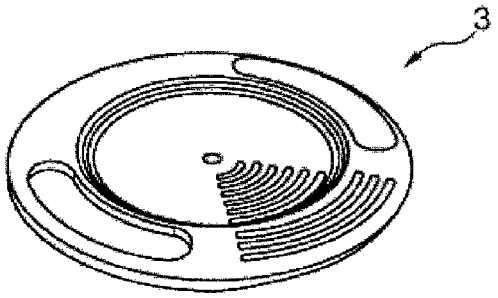
FIGS. 1 to 3 are perspective views of the elements comprised by the proposed locking device.

Having reference to the drawings, the proposed locking device 1 is intended to be assembled so as to permit locking of an obturating stopper on a container 101 and thus ensure both the impermeability thereof and the integrity of the contents of container 101. Container 101 is of the flanged 102 type, such flange being delimited by a neck 103, whose cross section is narrower than that of the rest of container 101. Stopper 100 is in the shape of a mushroom whose stem 104 fits inside neck 103 and whose cap 105 sits on top of flange 102. Stopper 100 is, in order to ensure optimal impermeability, made, for example, of elastomer. Locking device 1 comprises a cap 2, a capsule 3 and a collar 4.

Figure 2A:
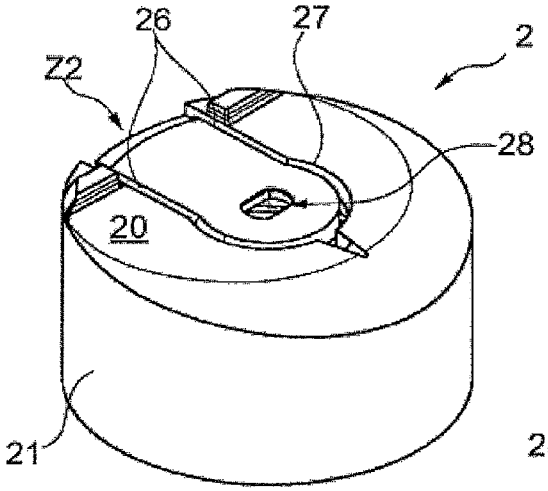
Figure 2B:
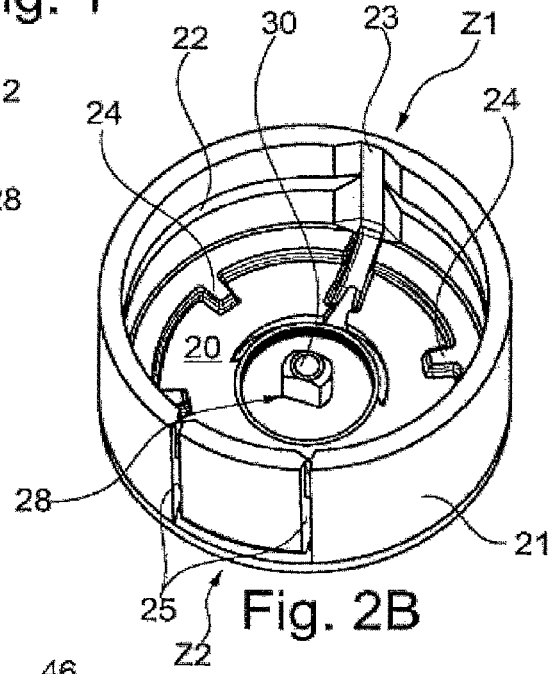
Figure 4:
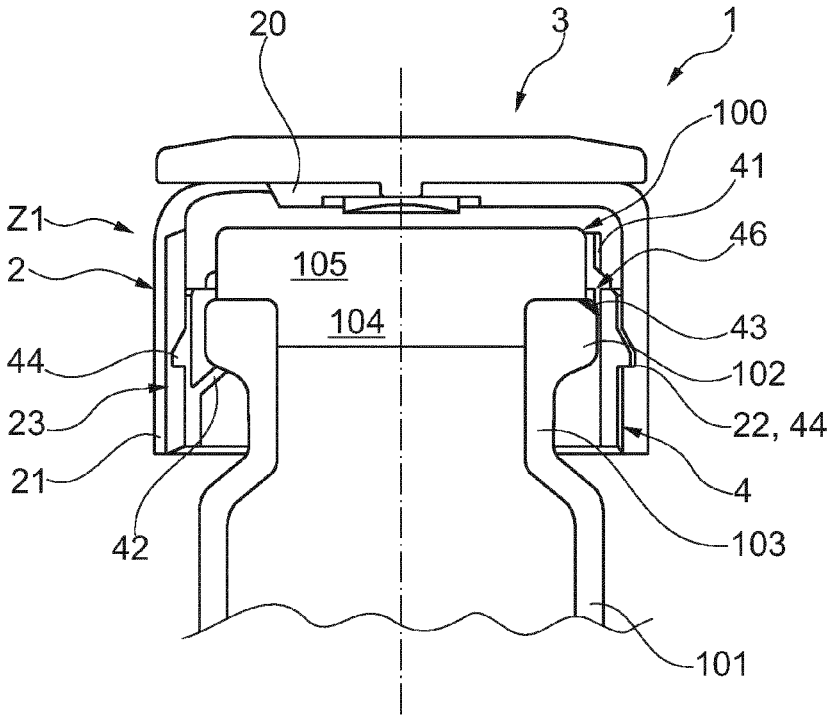
FIG. 4 is a cut-away view of a container having a flange and fitted with the locking device as proposed in a locked configuration.

Having reference to FIGS. 2A and 2B, cap 2, which is made from a plastic material, comprises a disk 20 that is extended axially by means of a skirt 21. The lower part of skirt 21 comprises an internal annular groove 22 and a recess 23 which, cutting across groove 22, is oriented axially over the integral height of skirt 21 while, by reducing the thickness of the wall of skirt 21, defining a hinge zone Z1. The external face of cap 2 features a double groove 25, 26, 27 along which the thickness of the wall of cap 2 is reduced. Double groove 25, 26, 27 comprises two first legs 25 that run parallel to each other and extend axially over the height of skirt 21. In the present example, the first legs 25 are arranged at a distance from the free end of skirt 21 but can also be oriented at a tangent to the free end of skirt 21. The first two legs 25 are extended by means of two second legs 26 that run parallel to each other over disk 20, and are oriented radially relative to skirt 21 toward the center of disk 20, at the limits whereof they are joined together by means of a circular section 27. Double groove 25, 26, 27 thus demarcates a frangible zone Z2 that can rupture in order to split cap 2 and so permit the opening and removal thereof from flange 102 of container 101. In order to facilitate the opening of cap 2, first legs 25 of frangible zone Z2 are arranged diametrally opposite hinge zone Z1. The center of disk 20 is traversed by an orifice 28 that thus also traverses frangible zone Z2. Disk 20 is intended to be covered by a peelable capsule 3, illustrated by the FIG. 1, the center whereof features a catch 30, which, being visible on FIG. 2B (prior to snapping on) and 4 (after snapping on), is intended to traverse orifice 28 of cap 2 to which it can be attached by snapping on as shown in FIG. 4. Catch 30 and orifice 28 thus constitute an anchoring point between capsule 3 and cap 2 and, more particularly, between capsule 3 and frangible zone Z2. Capsule 3, being made from a plastic material that is more flexible than that of cap 2, is readily deformable. Thus, one edge of capsule 3 can be raised and then pulled, which in turn lifts up frangible zone Z2. Cap 2 is thus so formed that, when it is placed on top of stopper 100, it covers the latter while surrounding flange 102 of container 101, an arrangement that renders stopper 100 inaccessible.

Figure 3:
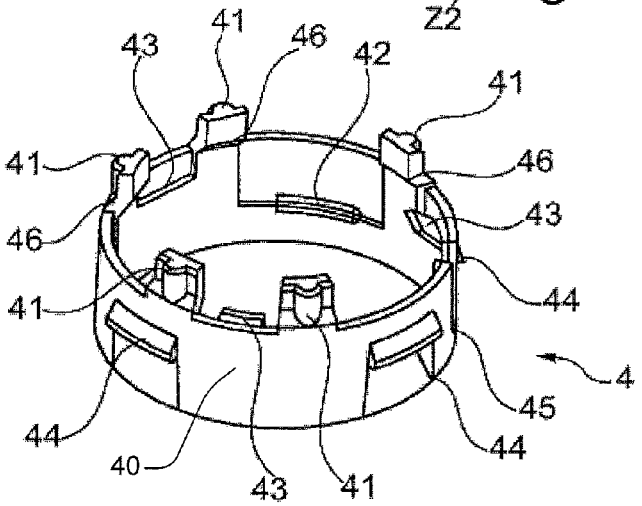

Having reference to FIG. 3, collar 4, which is made of plastic material, is formed from a substantially cylindrical band 40 that is extended by means of tenons 41. Collar 4 is suitable for being housed inside cap 2 and for surrounding flange 102 of container 100. On its inner wall, band 40 features three lower internal lugs 42 that are aligned in an axial plane as well as three upper internal lugs 43 that are aligned in an axial plane distinct from the former. Both lower internal lugs 42 and upper internal lugs 43 are staggered and are regularly spaced relative to one another. Both upper internal lugs 43 and lower internal lugs 42 are formed from flexible tabs that are inclined and oriented toward tenons 41. Band 40 is provided on its external wall with five regularly spaced external lugs 44 that are aligned in an axial plane distinct from those of the former. In the present example, external lugs 44 are disposed axially between internal lower lugs 42 and upper internal lugs 43. Band 40 comprises a bridge 45 which, being arranged opposite tenons 41, is of a height that is reduced relative to the rest of band 40. Bridge 45 is elastically deformable, thus permitting a slight elastic radial deformation of band 40 as well as the pushing away and inclination of the walls of band 40 on both sides of bridge 45. In addition, bridge 45 can break in order to allow, after breaking, the removal of collar 4 from flange 102 of container 101. Tenons 41 extend axially from band 40. In the present example, there are five tenons 41 and, except within the zone of bridge 45, these are spaced regularly around band 40. Each tenon 41 is disposed between an upper internal lug 43 and a lower internal lug 42. The free end of each of tenons 41 is arranged independently of each of the others. Each tenon 41 is offset relative to the axis and toward the inside of band 40 so as to form an internal web 46 that is intended to provide support against flange 102. Cap 2, collar 4 and capsule 3 can be produced by molding, for example, with the aid of an injection molding machine.

Figure 5:
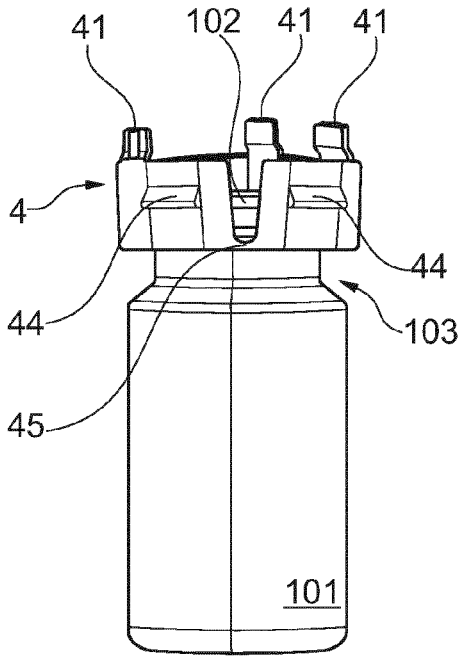
FIGS. 5 and 6 are perspective views illustrating two assembly stages for one part of the proposed locking device on a flanged container.
Figure 6:
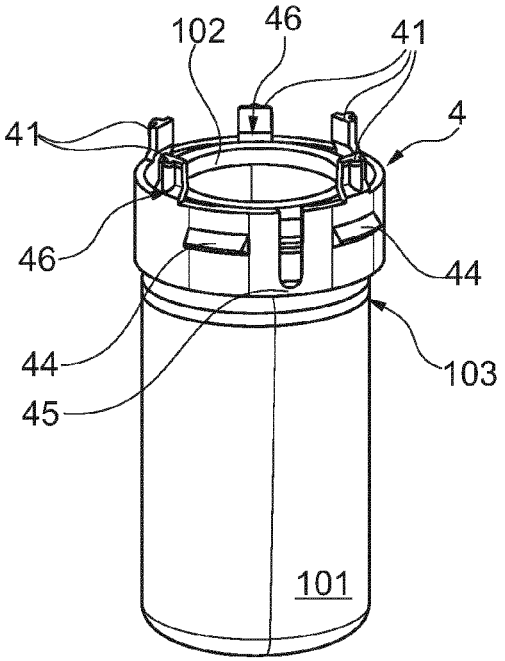

The assembly of locking device 1 and the mounting thereof on flange 102 of a container 101 are effected as follows. First, with the aid of catch 30 and orifice 28, capsule 3 is snapped onto cap 2 in the manner described above. Secondly, collar 4 and the tenons 41 thereof are arranged so as to face the inside of skirt 21 of cap 2 whereupon collar 4 is inserted into cap 2. During this insertion procedure, external lugs 44 of collar 4 deform elastically prior to springing back inside groove 22. Collar 4 is thus blocked inside cap 2. Thirdly, use is made of a container 101 having a flange 102 and obturated by means of a stopper 100 that is inserted into a cap 2 having a collar 4. During this insertion step, bridge 45 permits the elastic deformation of collar 4 inside cap 2 in order to permit the passage of stopper 100 and flange 102 into collar 4, as illustrated by FIG. 5 wherein only collar 4 and container 101 are shown. Following the forced insertion of flange 102, collar 4 resumes its initial shape as shown in FIG. 6. In this configuration, flange 102 is housed and blocked between lower internal lugs 42 and upper internal lugs 43. Stopper 100, which ensures the impermeability of container 101, and, receiving support from upper internal lugs 43, is wedged between tenons 41. Stopper 100 thus becomes locked onto container 101 by means of locking device 1 which completely envelopes said stopper 100 and thus renders it inaccessible.

Figure 7:
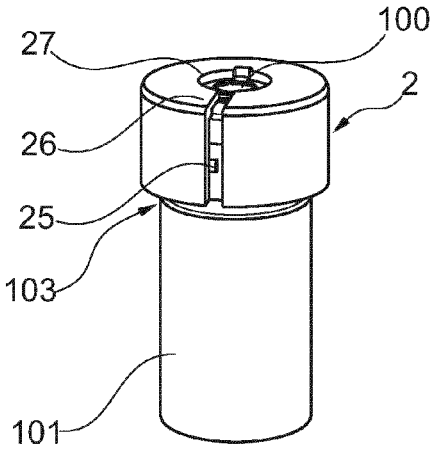
FIGS. 7 to 11 are perspective views illustrating five stages of unlocking the proposed locking device as borne upon a flanged container.
Figure 8:
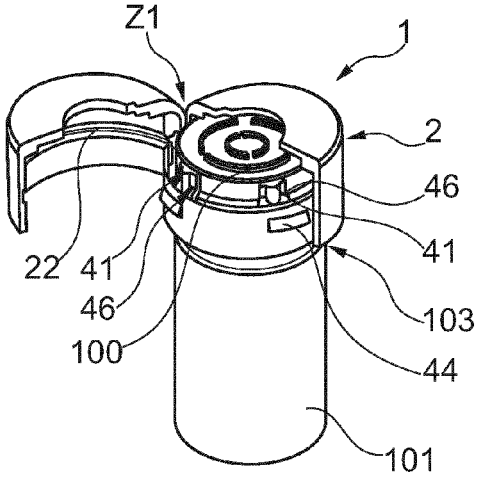
Figure 9:
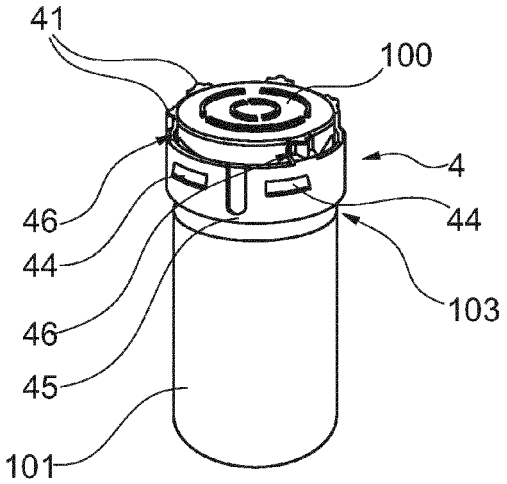
Figure 10:
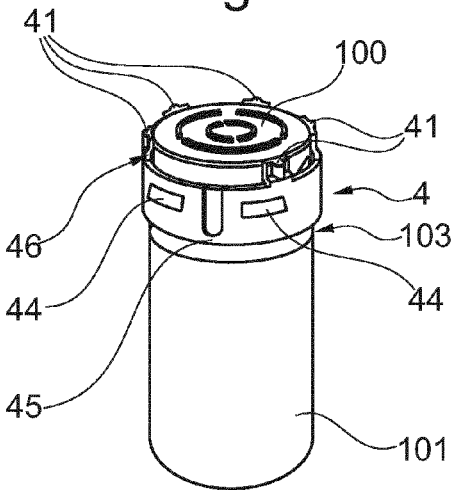
Figure 11:
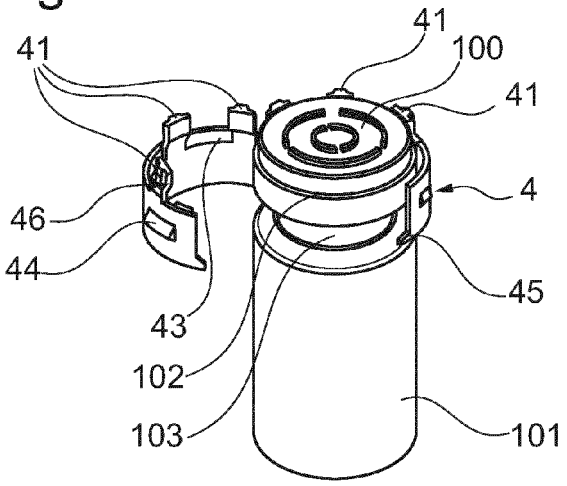

Having reference to FIGS. 7 to 11, the steps for removing locking device 1 are hereinafter described. First, the user grasps one edge of capsule 3 in order to lift it and exert tractive effort thereupon. Such tractive effort is transmitted from capsule 3 to frangible zone Z2 via catch 30 that has been snapped into orifice 28. Sufficient tractive effort is hereby deployed so as to cause the rupture of frangible zone Z2. As shown by FIG. 7, this action causes cap 2 to split open. Secondly, having reference to FIG. 8, cap 2 is opened by the forcing apart of the sections thereof on either side of hinge zone Z1. Cap 2 is removed from the container which, in FIG. 9, is shown only with collar 4. Thirdly, having reference to FIG. 10, bridge 45 is broken and, having reference to FIG. 11, cap 2 is opened when the sides thereof are pushed apart. Fourthly, stopper 100 is removed from container 101.

The present device permits the accomplishment of the aforementioned objectives. Flange 102, which thus becomes completely disencumbered following removal of cap 2 and of collar 4, can now be connected to any connecting means for the purpose of decanting the contents of container 101 and/or introducing a product into container 101. It will doubtless be appreciated that the present invention is not limited to the foregoing description of one of the embodiments thereof, which can be modified without surpassing the scope of the invention.

The invention claimed is:

1. A device for locking a stopper on a container having a flange, the locking device comprising:

a cap with at least one internal groove, the cap being shaped so as to cover the stopper and surround the flange and thereby render the stopper inaccessible; and a collar capable of being housed inside the cap and having lower internal lugs that provide support beneath the flange in order to cause the collar to interlock with the container and the collar having external lugs that engage with the groove in order to cause the collar to interlock with the cap, the cap further including at least one frangible zone capable of rupturing so as to permit the opening of the cap and the withdrawal thereof relative to the flange, the collar being formed from a band that is extended by tenons that surround the stopper, the collar being provided with at least one deformable and breakable bridge that is arranged opposite the tenons and able on the one hand to elastically deform radially in order to permit the forced insertion of the flange into the collar and on the other hand to be broken in order to permit the withdrawal of the collar relative to the flange and then the withdrawal of the stopper from the container.

2. The locking device in accordance with claim 1, wherein the tenons have free ends that are arranged independent of each other.

3. The locking device in accordance with claim 1, wherein each of the tenons is provided with at least one internal web whose diameter is less than that of the band and is intended to provide support against the flange.

4. The locking device in accordance with claim 1, wherein the collar includes upper internal lugs that are intended to press against the stopper.

5. The locking device in accordance with claim 1, wherein the cap includes a disk that is extended axially by a skirt, the frangible zone being delimited by a double groove of a thickness that is reduced relative to the rest of the cap and including at least a first leg extending over at least part of the skirt and at least a second leg extending over at least part of the disk, the locking device further comprising a peelable capsule that is interlinked with at least one anchoring point of the frangible zone so as to allow the withdrawal of the capsule in order to initiate rupture of the frangible zone.

6. The locking device in accordance with claim 5, wherein the cap includes a hinge zone of a thickness that is reduced relative to the rest of the cap and is arranged diametrally opposite the second leg of the frangible zone and so arranged as to permit the radial opening of the cap following rupture of the frangible zone.

7. The locking device in accordance with claim 5, wherein at least one of the cap, the collar and the capsule is made from molded plastic material.

8. A container assembly, comprising:

king device in accordance with claim 1; and the container, wherein an opening in the container is obstructed by the stopper, and whereby the stopper is axially blocked between the collar and the cap.

9. A locking device for locking a stopper on a container having a flange, the locking device comprising:

a collar configured to surround the stopper and to secure the stopper to the flange of the container; and a cap configured to surround and be secured to the collar and configured to cover the stopper to prevent access to the stopper, the cap including a disk, a skirt that extends axially from the disk and is configured to surround the stopper, and a frangible zone disposed in the disk and the skirt, wherein the frangible zone is configured to rupture to allow removal of the cap from the collar and thereby allow access to the stopper wherein the cap includes a hinge zone disposed in the skirt that allows portions of the cap disposed on opposite sides of the hinge zone to be pivoted about the hinge zone in a direction away from each other.

10. The locking device of claim 9, wherein the hinge zone is defined by a recess extending axially in the skirt, the recess having a reduced thickness relative to portions of the skirt disposed on opposite sides of the recess.

11. A locking device for locking a stopper on a container having a flange, the locking device comprising:

a collar configured to surround the stopper and to secure the stopper to the flange of the container; and a cap configured to surround and be secured to the collar and configured to cover the stopper to prevent access to the stopper, the cap including a disk, a skirt that extends axially from the disk and is configured to surround the stopper, and a frangible zone disposed in the disk and the skirt, wherein the frangible zone is configured to rupture to allow removal of the cap from the collar and thereby allow access to the stopper wherein the skirt of the cap includes an internal annular groove and the collar includes external lugs that are configured to engage the internal annular groove of the cap to secure the collar within the cap.

12. The locking device of claim 11, wherein the external lugs of the collar are configured to flex radially inward as the collar is inserted into the cap and to flex radially outward into the internal annular groove of the cap when the external lugs are axially aligned with the internal groove.

13. The locking device of claim 11, wherein the frangible zone is disposed in both the disk and the skirt.

14. The locking device of claim 11, wherein the cap includes a frangible zone groove that demarcates the frangible zone.

15. The locking device of claim 14, wherein the groove includes a first pair of grooves extending axially in the skirt of the cap, a second pair of grooves extending radially in the disk of the cap, and a single groove extending around a center of the disk.

16. The locking device of claim 15, wherein the first pair of grooves extends from the second pair of grooves to a free end of the skirt.

17. A stopper-to-container locking device comprising:

a stopper-surrounding collar including a substantially cylindrical band and tenons that extend axially from the band beyond an axial end of the band, the tenons having free ends that are unconnected to one another; and a stopper-covering cap operably secured to the collar, the cap including a disk and a skirt that extends axially from the disk, wherein the collar includes a bridge disposed in the cylindrical band and configured to elastically deform to permit passage of a stopper and a flange of a container into the collar.

18. The locking device of claim 17, wherein the bridge is configured to break before the rest of the cylindrical band breaks when a removal force is applied to the collar.

19. The locking device of claim 17, wherein the bridge has a reduced height relative to the rest of the cylindrical band.

20. A locking device for a container, the locking device comprising:

a stopper;

a collar configured to surround the stopper and to secure the stopper to the container;

a cap configured to be secured to the collar and configured to surround the collar and the stopper to inhibit removal of the stopper from the container, the cap including a disk, a skirt that extends axially from the disk, and a breakable area in at least one of the disk and the skirt; and a capsule configured to be attached to the breakable area of the cap such that a removal force can be applied to the capsule to rupture the breakable area to allow removal of the cap from the container.

21. The locking device of claim 20, wherein the breakable area is demarcated by a boundary that extends axially along the skirt of the cap, radially along the disk of the cap, and circumferentially around the attachment between the capsule and the cap.

22. The locking device of claim 21, wherein the cap includes a hinge zone disposed in the skirt, wherein portions of the cap disposed on opposite sides of the hinge zone are pivotable away from each other about the hinge zone when the breakable area is ruptured.

23. The locking device of claim 22, wherein the hinge zone is disposed diametrically opposite from a segment of the boundary that extends axially along the skirt of the cap.

24. The locking device of claim 21, wherein rupturing the boundary separates the breakable area from the remainder of the cap and allows detachment of the capsule from the cap.

25. A locking device for a container, the locking device comprising:

a collar configured to surround a stopper and to secure the stopper to the container;

a cap configured to be secured to the collar and configured to surround the collar and the stopper, the cap including a disk, a skirt that extends axially from the disk, and a frangible zone disposed at least partially in the skirt; and a capsule configured to be attached to the frangible zone of the cap.

26. The locking device of claim 25, wherein the frangible zone is disposed in the disk and the skirt.

27. The locking device of claim 26, wherein the frangible zone is demarcated by a boundary that extends axially along the skirt of the cap, radially along the disk of the cap, and circumferentially around the attachment between the capsule and the cap.

* * * * *